US005732573A

United States Patent [19]

Sexton

[11] Patent Number: 5,732,573

[45] Date of Patent: Mar. 31, 1998

[54] WARP KNITTED TEXTILE FABRIC

[75] Inventor: Wayne K. Sexton, Lilesville, N.C.

[73] Assignee: Hornwood, Inc., Lilesville, N.C.

[21] Appl. No.: 665,400

[22] Filed: Jun. 18, 1996

[51] Int. Cl.[6] ..... D04B 21/00

[52] U.S. Cl. ..... 66/195

[58] Field of Search ..... 66/193, 194, 195, 66/196

[56] References Cited

U.S. PATENT DOCUMENTS

| | | | |
|---|---|---|---|
| 2,249,342 | 7/1941 | Aull | 66/195 |
| 3,308,827 | 3/1967 | Gross | 66/195 X |
| 3,578,028 | 5/1971 | Roberts | 66/195 X |
| 3,716,446 | 2/1973 | Dean | 161/91 |
| 4,377,195 | 3/1983 | Weil | 160/237 |
| 4,435,467 | 3/1984 | Rogers | 428/254 |
| 5,131,100 | 7/1992 | Atwater et al. | 2/405 |
| 5,385,036 | 1/1995 | Spillane et al. | 66/87 |

FOREIGN PATENT DOCUMENTS

| | | | |
|---|---|---|---|
| 2503497 | 9/1975 | Germany | 66/195 |

*Primary Examiner*—John J. Calvert
*Attorney, Agent, or Firm*—Adams Law Firm, P.A.

[57] ABSTRACT

A warp knitted fabric characterized by enhanced dimensional stability while maintaining adequate ventilation for use in athletic and recreational apparel. The fabric is a two bar warp knitted fabric having spaced-apart substantially circular single course ventilation openings. According to one preferred embodiment, the fabric is constructed according to the pattern 1-0, 1-2, 3-4, 5-6, 7-8, 7-6, 5-4, 3-2 for the front bar of the two bars and 7-8, 7-6, 5-4, 3-2, 1-0, 1-2, 3-4, 5-6 for the back bar of the two bars, and the warp knitting machine is threaded 11 in, 1 out for the front bar.

9 Claims, 4 Drawing Sheets

WARP KNITTED TEXTILE FABRIC

FIELD AND BACKGROUND OF THE INVENTION

This invention relates to a warp knitted textile fabric, particularly a warp knitted textile fabric of the type manufactured on a tricot warp knitting machine. Fabrics of the type disclosed and claimed in this application can also be produced on a Raschel-type warp knitting machine. The fabric is particularly useful in garment manufacturing for the fabrication of athletic and recreational apparel, such as, for example, team jerseys. In such garments ventilation is essential to permit evaporation of perspiration and cooling of the wearer. Strength is also essential, since such garments are typically subjected to severe stretching, pulling and tearing forces.

One prior art type of warp knitted fabric is known as "eyelet mesh", and has large, elongated, oval openings in the fabric. These openings are formed by a four course repeat in the warp knit stitch pattern. The openings are sufficiently large that in such fabrics the surface area of the opening may be in the range of 50 percent of the total surface area of the fabric, even though the number of openings per square inch is relatively low. The relatively large openings increase the elongation or stretch of the garment in the direction of the long axis of the oval openings.

In addition, the eyelet mesh openings are so large that in many instances undergarments and equipment worn under the eyelet mesh garment are visible, particularly if of a contrasting color. These features decrease the useful life of the eyelet mesh garments and sometimes require the wearing of additional or different types of undergarments.

Another prior art type of warp knitted fabric is known as "micro mesh." This type of fabric has a multitude of openings per inch—on the order of 168 per square inch—and is essentially nothing more than openings surrounded by a yarn matrix just sufficient to maintain the integrity of the fabric. The ratio of the surface area of the openings to the total surface area in micro mesh fabrics is very high. The appearance of the fabric resembles a "waffle" of densely packed openings similar to spandex or elastic medical fabrics and undergarments. This appearance is sometimes objectionable in athletic and recreational apparel.

The present invention solves these problems by providing a fabric which is attractive and distinctive in appearance, provides adequate ventilation for athletic and recreational purposes, and is strong and is substantially opaque, so that undergarments are not readily visible through the fabric.

SUMMARY OF THE INVENTION

Therefore, it is an object of the invention to provide a fabric which has an attractive and distinctive appearance.

It is another object of the invention to provide a fabric which is strong and resistant to stretching and pulling.

It is another object of the invention to provide a fabric which has a relatively low percentage of ventilation opening surface area in relation to the total surface area of the fabric.

It is another object of the invention to provide a fabric which has ventilation openings which are substantially circular in shape.

It is another object of the invention to provide a fabric which has a unique stitch pattern which inherently produces a fabric having the characteristics referred to above.

These and other objects of the present invention are achieved in the preferred embodiments disclosed below by providing a warp knitted fabric characterized by enhanced dimensional stability while maintaining adequate ventilation for use in athletic and recreational apparel. The fabric comprises a two bar warp knitted fabric having spaced-apart substantially circular single course ventilation openings.

According to one preferred embodiment of the invention, the fabric is constructed according to the pattern 1-0, 1-2, 3-4, 5-6, 7-8, 7-6, 5-4, 3-2 for the front bar of the two bars and 7-8, 7-6, 5-4, 3-2, 1-0, 1-2, 3-4, 5-6 for the back bar of the two bars.

According to another preferred embodiment of the invention, the warp knitting machine is threaded 11 in, 1 out.

According to yet another preferred embodiment of the invention, the circular ventilation openings defined by the single course openings comprise no more than 25 percent of the surface area of the fabric.

According to yet another preferred embodiment of the invention, the circular ventilation openings defined by the single course openings comprise between 5 percent and 15 percent of the surface area of the fabric.

According to yet another preferred embodiment of the invention, the circular ventilation openings defined by the single course openings comprise no more than 40 ventilation openings per square inch and no more than 25 percent of the surface area of the fabric.

According to yet another preferred embodiment of the invention, the circular ventilation openings defined by the single course openings comprise between 10 and 40 ventilation openings per square inch and between 5 percent and 15 percent of the surface area of the fabric.

According to yet another preferred embodiment of the invention, the fabric is warp knitted on a tricot warp knitting machine.

According to yet another preferred embodiment of the invention the fabric is knitted on a 20 gauge machine.

According to yet another preferred embodiment of the invention, the fabric is knitted on a 28 gauge machine.

According to yet another preferred embodiment of the invention the fabric has at least 15 ends per inch.

Preferably, the invention comprises a warp knitted fabric characterized by enhanced dimensional stability while maintaining adequate ventilation for use in athletic and recreational apparel and active wear. The fabric preferably comprises a two bar warp knitted fabric having a single course opening in each repeat defining a substantially circular ventilation opening, wherein the fabric is constructed according to the pattern 1-0, 1-2, 3-4, 5-6, 7-8, 7-6, 5-4, 3-2 for the front bar and 7-8, 7-6, 5-4, 3-2, 1-0, 1-2, 3-4, 5-6 for the back bar. The warp knitting machine is threaded 11 in, 1 out for bar 2, and 5 in, 1 out 6 in for bar 1.

Preferably, the circular ventilation openings defined by the single course openings comprise approximately 5 percent of the surface area of the fabric and comprise approximately 16 ventilation openings per square inch of surface area of the fabric.

Preferably, the fabric is knitted on a 28 gauge warp knitting machine.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF PRIOR ART

Figure 1:
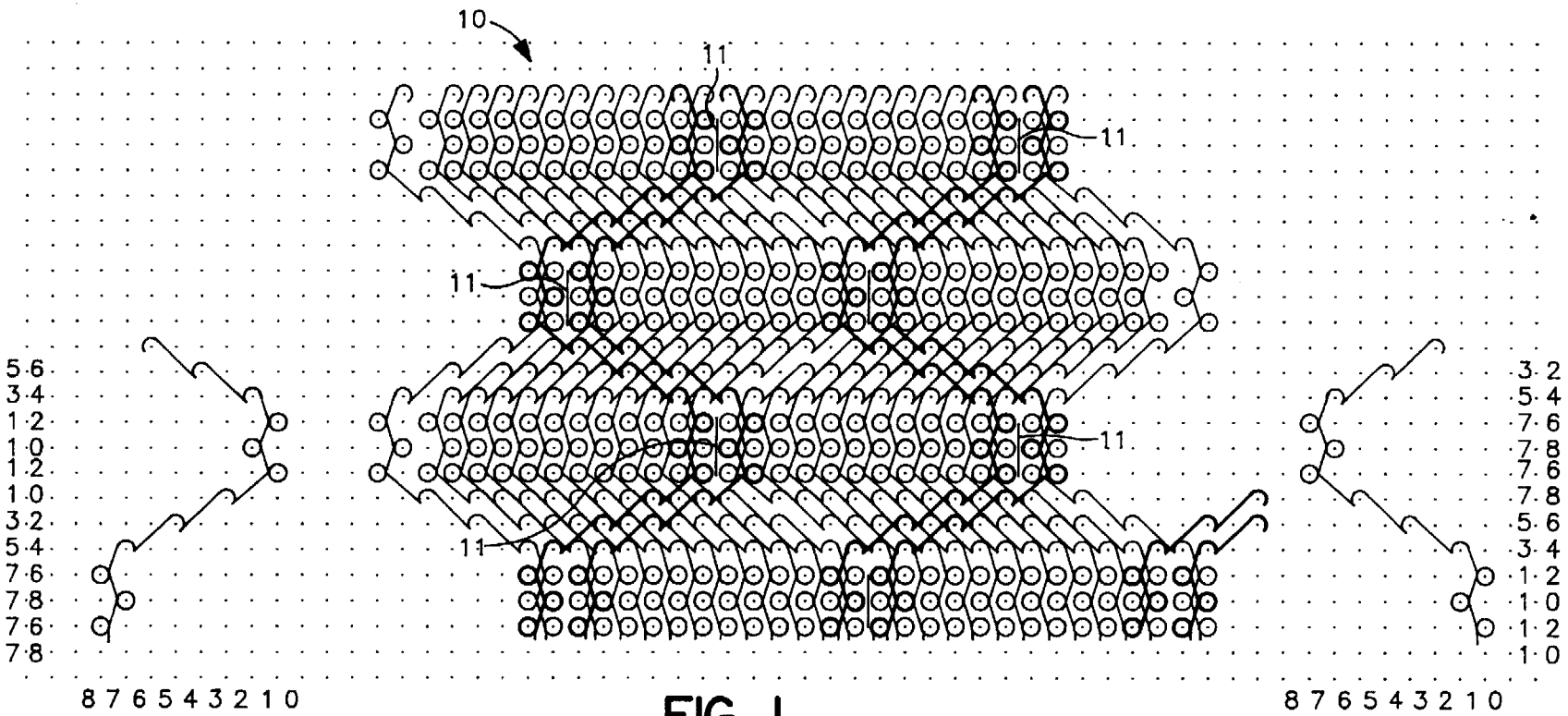
FIG. 1 (PRIOR ART)
FIG. 1 is a stitch pattern for a prior art warp knit fabric used for athletic and recreational apparel.
Figure 2:
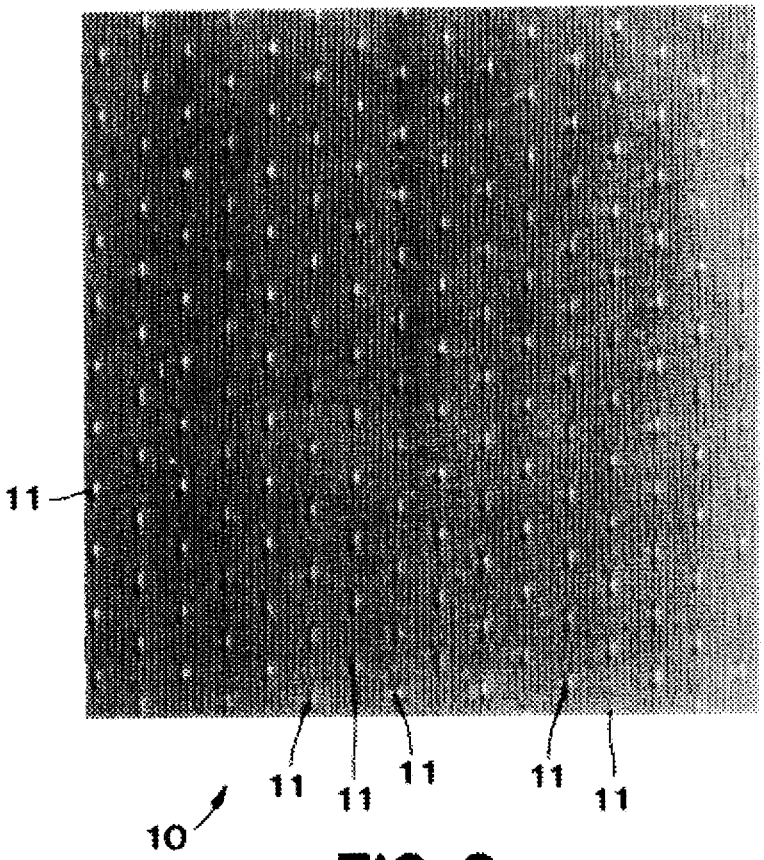
FIG. 2 (PRIOR ART)
FIG. 2 is an illustration of the surface appearance of the warp knit fabric resulting from the stitch pattern shown in FIG. 1.

Referring now specifically to the drawings, a prior art mesh warp knit typically used to fabricate athletic and recreational garments is illustrated in FIGS. 1 and 2. This fabric has the following stitch pattern:

Bar 2 (Front): 1-0, 1-2, 1-0, 1-2, 3-4, 5-6, 7-8, 7-6, 7-8, 7-6, 5-4, 3-2.

Bar 1 (Back): 7-8, 7-6, 7-8, 7-6, 5-4, 3-2, 1-0, 1-2, 1-0, 1-2, 3-4, 5-6.

The machine is threaded as follows:

Bar 2 (Front): 5 in—1 out—6 in.

Bar 1 (Back): 11 in—1 out.

As is shown in FIG. 2, this stitch pattern results in a fabric 10 having relatively large, elongated, oval ventilation openings 11. In the particular pattern arrangement shown in FIGS. 1 and 2, the fabric is warp knitted on a 28 gauge warp knitting machine of 70 denier polyester on a 168 inch-wide machine, with 4296 total ends, or approximately 26 ends per inch. Each opening has an equivalent diameter of approximately 3/16ths inch, obtained by dividing the sum of the length of the long axis of the opening 11 by the length of the short axis and dividing by 2. There are 16 openings per square inch, with the result that, according to the formula ($A=\pi r^2$), the openings 11 occupy approximately 25 percent of the surface area of the fabric 10. This high percentage of open area together with the large openings results in a fabric which is subject to stretching, tearing and sagging.

The oval shape of the openings 11 results from the repeat [1-0, 1-2, 1-0, 1-2] on Bar 2. The location and orientation of the oval openings 11 are indicated on FIG. 1.

The oval shape of the openings 11 creates substantially greater fabric stretch along the long axis of the opening. In extreme cases, stretching may reach the point where fingers may be extended through the openings, promoting tearing or ripping during athletic activity. The stretch can also result in difficulties during cutting and sewing with consequent gapping, puckering and other defects.

DESCRIPTION OF THE PREFERRED EMBODIMENT AND BEST MODE

Figure 3:
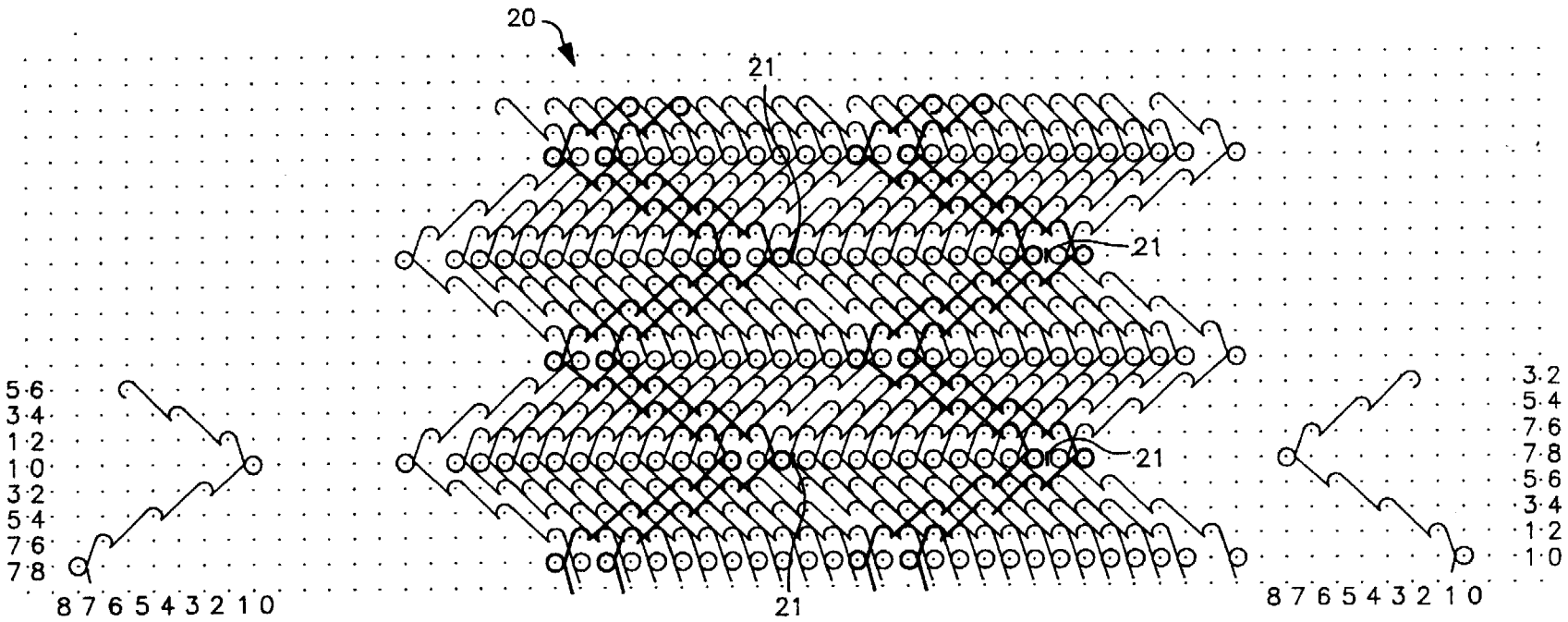
FIG. 3 is a stitch pattern for a warp knit fabric according to a preferred embodiment of the present invention.
Figure 4:
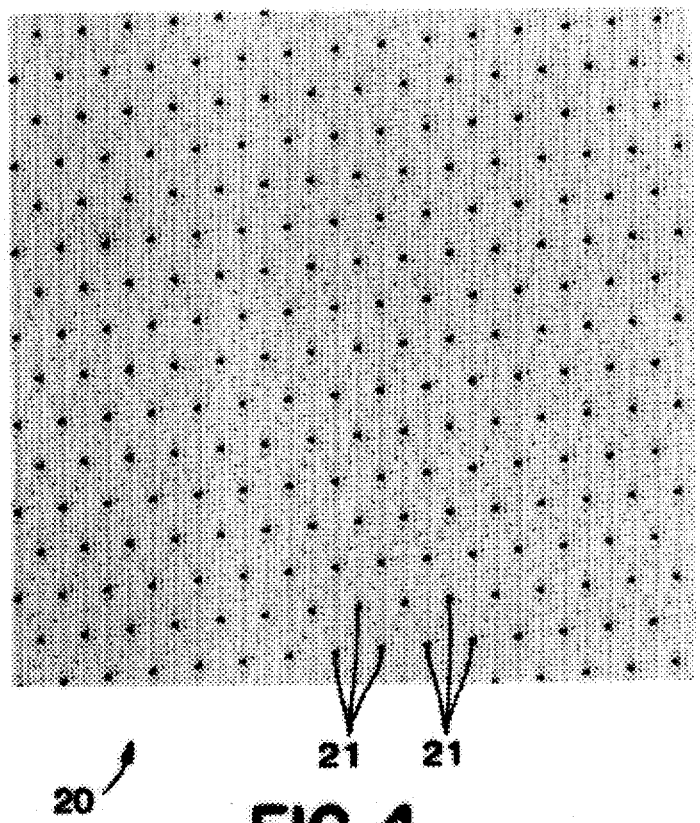
FIG. 4 is an illustration of the surface appearance of the warp knit fabric resulting from the novel stitch pattern shown in FIG. 3.

A fabric according to the present invention is illustrated in FIGS. 3 and 4 and shown generally at reference numeral 20. The fabric 20 has a unique and distinctive appearance resulting from the size, spacing and shape of the openings 21 formed in the fabric 20 during warp knitting.

The stitch pattern for fabric 20 is as follows:

Bar 2 (Front): 1-0, 1-2, 3-4, 5-6, 7-8, 7-6, 5-4, 3-2.

Bar 1 (Back): 7-8, 7-6, 5-4, 3-2, 1-0, 1-2, 3-4, 5-6.

The machine is threaded as follows:

Bar 2 (Front): 5 in—1 out—6 in.

Bar 1 (Back): 11 in—1 out.

As is shown in FIG. 4, this stitch pattern results in a fabric 20 having relatively small, circular ventilation openings 21. In the particular pattern arrangement shown in FIGS. 3 and 4, the fabric is warp knitted on a 28 gauge, 168 inch-wide warp knitting machine of 70 denier polyester, with 4296 total ends, or approximately 18 ends per inch. Each opening 21 has diameter of 1/16ths inch. There are 32 openings per square inch, with the result that, according to the formula ($A=\pi r^2$), the openings 21 occupy approximately 10 percent of the surface area of the fabric 20. This low percentage of open area results in a fabric which is extremely stable and tear and sag resistant. It cuts and sews easily and produces an apparel item which has a rich, solid look and feel, but which also provides adequate ventilation to the wearer. It is particularly suitable for athletic and recreational apparel. Use of the term "circular" or "substantially circular" is not intended to imply that the openings 21 must be circular in the geometric sense of having a center with radii of equal length radiating in every direction. Rather, the terms are intended to contrast the overall appearance of the openings 21 with the distinctly oval or oblong openings of prior art fabrics as described above. The openings 21 may have a somewhat diamond or teardrop-shaped periphery and still fall within the definition of circular as used in this application. Contract the shape of the openings 11 in FIG. 2 with the shape of the openings 21 in FIG. 4.

The circular shape of the openings 21 results from the repeat [1-0, 1-2,] on Bar 2. The location of the circular openings 21 are indicated on FIG. 3. The circular shape of the openings 21 results in a novel and unique appearance to the fabric, together with the other advantages mentioned above.

The fabric according to the invention can be made in numerous gauges on either tricot or Raschel warp knitting machines, and with texturized or flat nylon, polyester or other suitable yarns.

The following is an example of the variety of different constructions which can be made according to the stitch pattern of the invention:

Yarn: 150 denier polyester
Machine gauge: 20
Machine width: 168 inches
Total ends: 3072
Ends per inch: approx. 18
Opening diameter: 1/16th inch
Openings per square inch: 16

According to the formula ($A=\pi R^2$), the openings occupy approximately 5 percent of the surface area of the fabric.

Presently, applicant believes that due to the unusual nature of the stitch pattern, only an 11 in, 1 out back bar threading produces the novel fabric disclosed and claimed in this application.

Fabrics made according to the stitch pattern disclosed in this application range from 2768 to 5528 total ends on 18 to 36 gauge machines. Yarn deniers range from 15 to 300 denier. The novel fabrics disclosed in this application principally utilize 40, 70, 100 and 150 denier yarns.

A novel fabric pattern is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A dimensionally-stable warp knitted fabric for use in athletic and recreational apparel and active wear, said fabric comprising a two bar Raschal or tricot warp knitted fabric having spaced-apart substantially circular single course ventilation openings, wherein:

(a) said fabric is constructed according to the pattern 1-0, 1-2, 3-4, 5-6, 7-8, 7-6, 5-4, 3-2 for the front bar of the two bars and 7-8, 7-6, 5-4, 3-2, 1-0, 1-2, 3-4, 5-6 for the back bar of the two bars;

(b) the warp knitting machine is threaded 11 in, 1 out for the front bar and 5 in, 1 out, 6 in for the back bar;

(c) the circular ventilation openings defined by the single course openings comprise no more than 25 percent of the surface area of the fabric;

(d) the circular ventilation openings defined by the single course openings comprise no more than 40 ventilation openings per square inch of surface area of the fabric.

2. A warp knitted fabric according to claim 1, wherein the circular ventilation openings defined by the single course openings comprise no more than 25 percent of the surface area of the fabric.

3. A warp knitted fabric according to claim 1, wherein the circular ventilation openings defined by the single course openings comprise between 5 percent and 15 percent of the surface area of the fabric.

4. A warp knitted fabric according to claim 1, wherein the circular ventilation openings defined by the single course openings comprise no more than 40 ventilation openings per square inch and no more than 25 percent of the surface area of the fabric.

5. A warp knitted fabric according to claim 1, wherein the circular ventilation openings defined by the single course openings comprise between 10 and 40 ventilation openings per square inch and between 5 percent and 15 percent of the surface area of the fabric.

6. A warp knitted fabric according to claim 1, wherein said fabric is knitted on a 20 gauge machine.

7. A warp knitted fabric according to claim 1, wherein said fabric is knitted on a 28 gauge machine.

8. A warp knitted fabric according to claim 1, wherein said fabric has at least 15 ends per inch.

9. A dimensionally-stable warp knitted fabric for use in athletic and recreational apparel and active wear, said fabric comprising a two bar Raschal or tricot warp knitted fabric having spaced-apart substantially circular single course ventilation openings, wherein:

(a) said fabric is constructed according to the pattern 1-0, 1-2, 3-4, 5-6, 7-8, 7-6, 5-4, 3-2 for the front bar of the two bars and 7-8, 7-6, 5-4, 3-2, 1-0, 1-2, 3-4, 5-6 for the back bar of the two bars;

a) the warp knitting machine is threaded 11 in, 1 out for the front bar and 5 in, 1 out, 6 in for the back bar;

(c) the circular ventilation openings defined by the single course openings comprise approximately 10 percent of the surface area of the fabric;

(d) the circular ventilation openings defined by the single course openings comprise approximately 32 ventilation openings per square inch of surface area of the fabric; and (e) said fabric is knitted on a 20 gauge warp knitting machine.

* * * * *